US008579144B2

(12) United States Patent
Cheney

(10) Patent No.: US 8,579,144 B2
(45) Date of Patent: Nov. 12, 2013

(54) SEWAGE EJECTOR BASIN EXTENSION

(76) Inventor: Kirk J Cheney, Carbondale, CO (US)

( * ) Notice: Subject to any disclaimer, the term of this patent is extended or adjusted under 35 U.S.C. 154(b) by 487 days.

(21) Appl. No.: 12/496,517

(22) Filed: Jul. 1, 2009

(65) Prior Publication Data

US 2011/0000924 A1 Jan. 6, 2011

(51) Int. Cl.
*B65D 25/00* (2006.01)

(52) U.S. Cl.
USPC ..... 220/567.1; 220/484

(58) Field of Classification Search
USPC ..... 220/484, 567.1; 405/52, 53; 137/363, 137/362
See application file for complete search history.

(56) References Cited

U.S. PATENT DOCUMENTS

| | | | | |
|---|---|---|---|---|
| 3,784,012 | A * | 1/1974 | Carlson | 210/170.08 |
| 4,527,708 | A * | 7/1985 | Dundas et al. | 220/484 |
| 4,655,361 | A * | 4/1987 | Clover et al. | 137/363 |
| 6,435,764 | B1 | 8/2002 | McNeely | |
| 6,666,349 | B1 * | 12/2003 | Gavin | 220/567.1 |
| 6,682,258 | B2 | 1/2004 | McNeely | |

FOREIGN PATENT DOCUMENTS

JP 3-127688 * 5/1991

OTHER PUBLICATIONS

Translated Abstract for JP 3-127688 date May 1991.*
AK Industries, Inc., PO Box 640, Plymouth, IN 46563, Product Information from website www.akindustries.com, Spring 2009.
Jackal Eco-Systems, 15314 Harrison Road, Mishawaka, IN 46546, Product Information from website www.jackalinc.com, Spring 2009.
Keidel Supply Co., Inc., 2026 Delaware Avenue, Norwood, OH 45212, Product Information from website www.keidel.com, Spring 2009.
Topp Industries Incorporated, North State Road 25, Rochester, IN, Product Information from website www.toppindustries.com, Spring 2009.

* cited by examiner

*Primary Examiner* — Stephen Castellano
(74) *Attorney, Agent, or Firm* — BL Speer & Associates; Brenda L. Speer

(57) ABSTRACT

During installation and before a floor or foundation slab is put in place, a sewage ejector basin is set below grade and a basin extension of the present invention set in place around the basin. The basin extension of the present invention is rectangular in shape and comprises four basin extension sidewalls in communicable relation to each other at right angles; an opening within a top of the basin extension to allow access to the basin; and an opening within a bottom of the basin extension to accommodate a basin. An inlet pipe is routed underground and into the basin. A discharge pipe and a vent pipe are routed out of the basin and through a basin lid, oriented horizontally in relation to the floor, passed through a basin extension sidewall of the basin extension of the present invention, routed under the floor and toward a wall of a mechanical room. The discharge pipe and the vent pipe may then be routed vertically upward either along, or preferably within, the wall and respectively connected to a sewer line that services the structure and vented to the outside of the structure.

12 Claims, 2 Drawing Sheets

SEWAGE EJECTOR BASIN EXTENSION

BACKGROUND OF THE INVENTION

1. Field of the Invention

The invention relates to an extension for a sewage ejector basin.

2. Description of Related Art Including Information Disclosed Under 37 CFR 1.97 and 37 CFR 1.98

Generally, sewage may be distributed from a sewage source to a desired location by gravity flow or by pumping. Nearly all residential plumbing systems rely on the force of gravity to supply incoming water and to provide for the discharge of waste. For example, for residential sewage, all sources of sewage in the residence may be located higher than a line running to the public sewer, a septic tank or alternate sewage treatment device (collectively referred to hereinafter as "sewer line"), and the sewage may be transported to the sewer line solely by gravity flow. However, there are times when gravity will not do the job.

For instance, if the sewage source is located at a lower elevation than the sewer line, then it becomes necessary to pump sewage to the sewer line. Occasionally, a fixture, such as a toilet or tub, needs to be installed below the nearest available sewer line and the sewage from the fixture must be lifted to the level of the sewer line. One example of such a situation is a bathroom installation in a basement where the sewer line is located higher than the toilet.

In such a situation, a sewage ejector pump has to be installed to lift sewage to the level of the sewer line. Ejector pumps are required where sewage or wastewater cannot flow to the sewer line by means of gravity at a velocity of at least two feet per second.

Sewage ejector assemblies may be installed to distribute sewage from a source to the sewer line. These assemblies typically include a round container or basin which receives sewage from the sewage source by means of an inlet pipe, and a pump for pumping the received sewage out of the container or basin by means of a discharge pipe, wherein the discharge pipe is connected to a sewer line.

A sewage ejector basin may be installed at grade in a hole or recess immediately beneath the floor or foundation slab, such that the top of the basin is flush with the floor or foundation slab. Alternatively, the sewage ejector basin may be installed below grade in a hole or recess some further distance (typically between about 6" to about 12") below the floor or foundation slab. In either installation situation, the inlet pipe to the sewage ejector basin is in connection with the sewage source, and the discharge pipe from the sewage ejector basin is in connection with the sewer line. After installation, any remaining space in the hole or recess around the sewage ejector basin is backfilled with soil.

If the sewage ejector basin is installed below grade, then a sewage ejector basin extension is required. The basin extension is circular and typically of about the same or slightly greater diameter as the outer perimeter of the sewage ejector basin. The basin extension is also of sufficient height to extend from the top of the basin to the top of the floor or foundation slab. The basin extension enables a basin to be installed below grade, surrounded by backfill and the floor or foundation slab abutted against the outer perimeter of the basin extension, such that the basin is not completely covered by the floor or foundation slab and, thus, providing for easy access to the basin for repair or maintenance.

Extensions from a below grade plumbing structure to a surface to maintain access to the plumbing structure are known. Examples of such extensions are manhole cover and catch-basin elevations as disclosed in U.S. Pat. No. 6,435,764 issued Aug. 20, 2002, by McNeely for a Nondestructive System for Adjusting Manhole and Catch-Basin Elevations and U.S. Pat. No. 6,682,258 issued Jan. 27, 2004, by McNeely for a Nondestructive System for Adjusting Manhole and Catch-Basin Elevations.

Sewage ejector basins with submersible pumps are known. Sewage ejector basins are available from various sources, including Jackel Eco-Systems, 15314 Harrison Road, Mishawaka, Ind. 46546, and Keidel Supply Co., Inc., 2026 Delaware Avenue, Norwood, Ohio 45212.

Extensions for sewage ejector basins are also known. Circular sewage ejector basin extensions are available from various sources, including AK Industries, Inc., PO Box 640, Plymouth, Ind. 46563, and TOPP Industries Incorporated, North State Road 25, Rochester, Ind.

With reference to FIG. 1, a sewage ejector basin installed below grade with a prior art basin extension is shown. The basin 2 is installed below the floor 14 and is surrounded by backfill 16. An inlet pipe 18 carries sewage into the basin 2. A discharge pipe 12 carries sewage pumped from the basin 2 to a sewer line. A pump power cord 10 connects and provides power to a pump (not shown) inside the basin 2. A basin extension 6 extends from a basin lid 4 to the surface of the floor 14. A vent pipe 8 extends from the basin 2 and allows for suction to be created within the basin 2 so that sewage may be pumped from the basin 2 through the discharge pipe 12 and to a sewer line. The prior art sewage ejector basin extension 6 has many disadvantages as further discussed below.

In the plumbing and heating trade, the mechanical room in a residence is often too small for the amount of equipment that is required to be placed in the mechanical room. Additionally, with the design of new residences, a sewage ejector tank or basin is often required to extract wastewater or sewage from the lower level of these residences. The sewage ejection system usually is required, either by a building code, or by engineering or architectural specifications, to be placed in the already too small mechanical room. Quite often the top surface of the sewage ejector basin is required to be placed below the floor, usually a concrete slab, of the basement level, to allow for wastewater or sewage drainage into and adequate volume use of the basin.

When a basin is installed below the level of the floor, a hole in the mechanical room floor is created. The space above this hole in which the basin is located then becomes unusable floor space. Furthermore, the available area within the mechanical room floor within which to locate a basin with a prior art, circular basin extension, such that the basin does not occupy valuable floor space, is limited.

Additionally, with the prior art circular basin extensions, the vent and discharge piping must extend vertically from and above the basin, which in turn further increases the unusable floor space, room area and wall space above and around the basin. The surface area enclosed within a prior art, circular basin extension is too restrictive and does not have adequate space to allow for discharge and vent piping to be horizontally oriented and parallel to the floor surface.

The prior art, circular basin extensions also do not allow for easy access to and service of the pumps within the basin post-installation. Additionally, access to the pumps through the prior art, circular basin extension is diminished greatly as the basin extension height is increased. The prior art, circular basins extensions are available in predetermined heights, typically 6 inches or 12 inches, thus, eliminating flexibility in determining basin depth below grade. Yet another disadvantage of the prior art, circular basin extensions is that no peripheral room is provided within the surface area enclosed within the basin extension for maneuvering to access the piping, basin and pump, because the prior art, circular basin extension is the same or slightly greater diameter as the basin.

BRIEF SUMMARY OF THE INVENTION

A sewage ejector basin extension of the present invention is rectangular in shape and comprises four basin extension sidewalls in communicable relation to each other at right angles. The basin extension has a top opening to allow access to the sewage ejector basin and a bottom opening to accommodate a sewage ejector basin.

An annular flange may be in relation to a top edge of the basin extension sidewalls and which annular flange runs along and around a top perimeter of the basin extension. The basin extension annular flange may removably receive an optional basin extension cover.

The basin extension may have a basin extension pan in perpendicular relation to the basin extension sidewalls, which basin extension pan has an opening therein to accommodate and abut the basin. Optionally, the basin extension pan may have a drain opening therein to accommodate a drain into the basin.

BRIEF DESCRIPTION OF THE SEVERAL VIEWS OF THE DRAWING(S)

LIST OF REFERENCE NUMERALS

Figure 1:
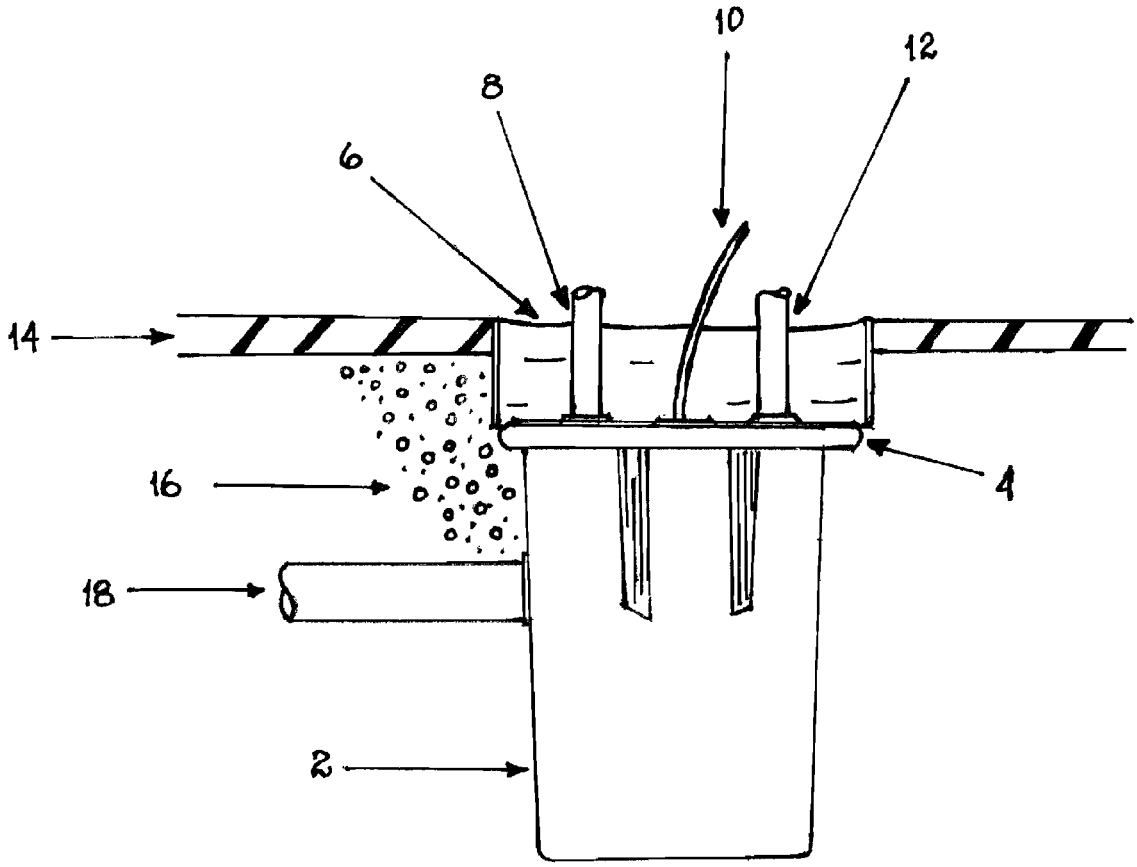
FIG. 1 is a cut-away, side view of an ejector basin with a prior art, circular basin extension.

2 basin
4 basin lid
6 prior art, circular basin extension
8 vent pipe
10 pump power cord
12 discharge pipe
14 floor
16 backfill
18 inlet pipe
20 pump power cord conduit
22 power junction box
24 basin extension
26 basin extension sidewall
28 basin extension annular flange
30 basin extension pan
32 drain opening

DETAILED DESCRIPTION OF THE INVENTION

As discussed above, installation of a sewage ejector basin is problematic. The rectangular basin extension of the present invention remedies the aforementioned problems.

With the basin extension of the present invention, the basin is installed in the middle of a mechanical room where other equipment will not be set. The discharge and vent pipes are routed horizontally under the floor or slab and then vertically upwards along or within a wall structure. As a result, the piping is not occupying and creating unusable space above the basin. The basin may have a removable lid over it allowing easy access and service to the basin, pumps, floats, and piping.

The advantages of the rectangular basin extension of the present invention are numerous. The basin can be placed anywhere in the mechanical or other room and not take up usable space in the room. The piping and routing under the slab through initial discharge is quieter. Because the basin is more accessible and the piping is not in the way, the access and service to the basin and pumps is much better. With the design of the rectangular basin extension, a predetermined depth of the tank is not required. This extension is adjustable for any installed depth of the tank below the finished floor. Service performed on the system is more sanitary, because all of the contaminated fluids can be contained within the basin extension and washed clean within the basin extension. The fluids can be washed back into the basin.

Figure 2:
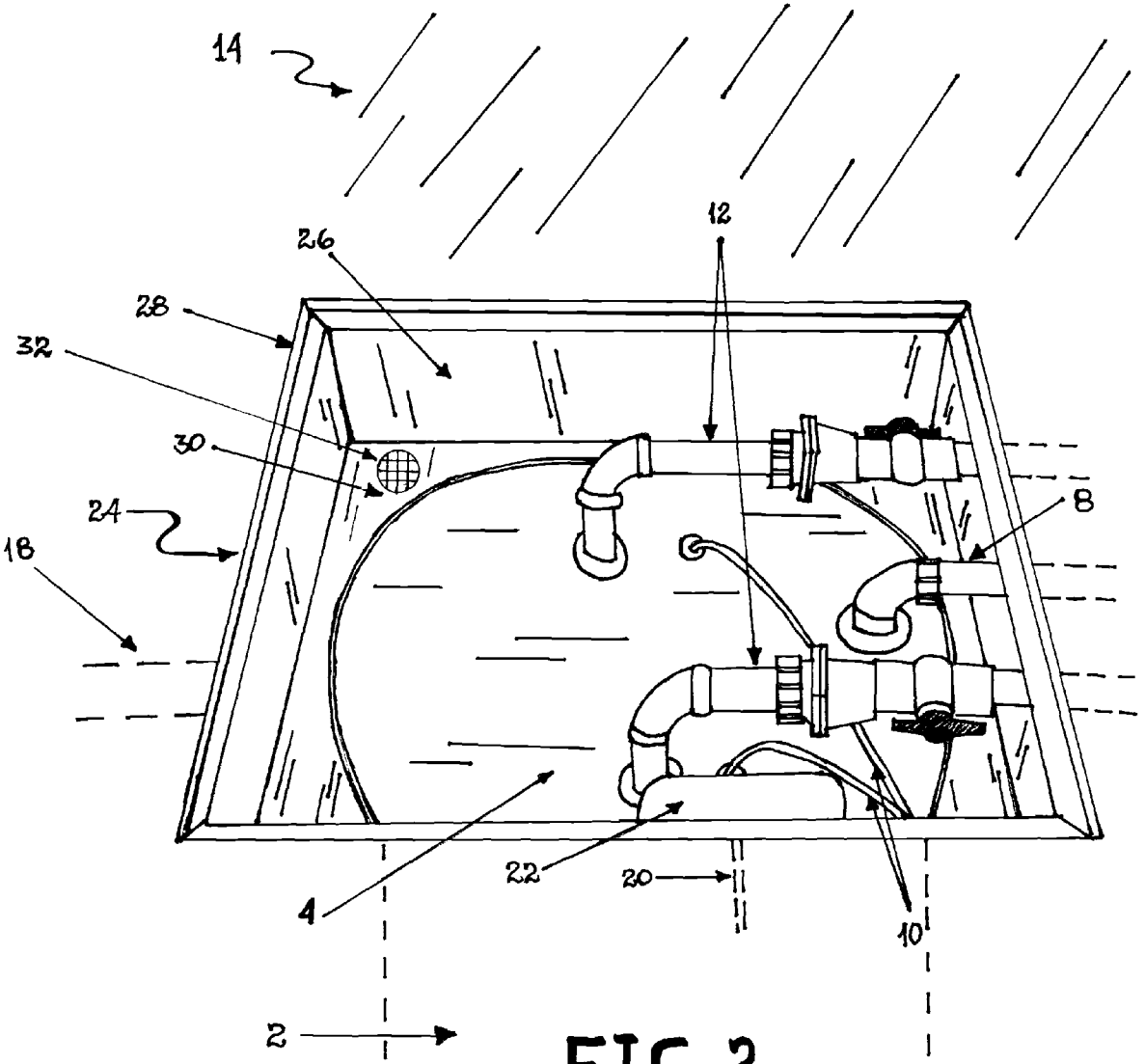
FIG. 2 is perspective view of an ejector basin with a rectangular basin extension of the present invention.

With reference to FIG. 2, a basin 2 with two pumps submerged therein (not shown) and with a basin extension 24 of the present invention is shown. The basin 2 may be installed in a residence or other structure. During installation and before a floor 14 or foundation slab is put in place, a basin 2 is set below grade and the basin extension 24 of the present invention set in place around the basin 2.

Next, an inlet pipe 18 is routed underground and into the basin 2. The inlet pipe carries wastewater and sewage discharged from plumbing fixtures, such as showers and toilets, into the basin 2.

A discharge pipe 12 for each pump is routed out of the basin 2 and through a basin lid 4, oriented horizontally in relation to the floor 14, passed through a basin extension sidewall 26 of the basin extension 24 of the present invention, routed under the floor 14 and toward a wall of a mechanical room. The discharge pipes 12 may then be routed vertically upward either along, or preferably within, the wall and connected to a sewer line that services the structure. A basin extension sidewall 26 may optionally have a pre-formed opening therein to accommodate the discharge pipe 12. Alternatively, an opening to accommodate the discharge pipe 12 may be made in a basin extension sidewall 26 onsite during installation.

In the same manner, a vent pipe 8 is routed out of the basin 2 and through the basin lid 4, oriented horizontally in relation to the floor 14, passed through a basin extension sidewall 26 of the basin extension 24 of the present invention, routed under the floor 14 and toward a wall of a mechanical room. The vent pipe 8 may then be routed vertically upward either along, or preferably within, the wall and vented to the outside of the structure. A basin extension sidewall 26 may optionally have a pre-formed opening therein to accommodate the vent pipe 8. Alternatively, an opening to accommodate the vent pipe 8 may be made in a basin extension sidewall 26 onsite during installation.

The pumps within the basin 2 are supplied with power by means of a power junction box 22. A pump power cord 10 may be run from an electricity source through a pump power cord conduit 20; wherein the pump power cord conduit 20 is routed underground, through the basin extension sidewall 26 and into the power junction box 22. Then the pump power cord 10 is routed through the basin lid 4 and connected to the pump (not shown) within the basin 2. A basin extension sidewall 26 may optionally have a pre-formed opening therein to accommodate the pump power cord 10 or the pump power cord conduit 20. Alternatively, an opening to accommodate the pump power cord 10 or the pump power cord conduit 20 may be made in a basin extension sidewall 26 onsite during installation.

After installation of the basin 2 system is completed, the basin 2, the inlet pipe 18, discharge pipe 12, vent pipe 8 and pump power cord conduit 20 are backfilled and covered. The ground is then leveled and prepared for the floor 14 or foundation slab to be poured and formed of cement. The cement is poured so that it abuts the outer perimeter of the basin extension 24 of the present invention. After the cement sets, the basin extension 24 of the present invention is contained within and flush with the floor 14.

The basin extension 24 of the present invention is rectangular in shape and has four basin extension sidewalls 26 in communicable relation to each other at right angles. A basin extension annular flange 28 is in relation to a top edge of the basin extension sidewalls 26 and runs along and around a top perimeter of the basin extension 24 of the present invention.

The basin extension annular flange 28 may removably receive a basin extension cover (not shown). When the basin extension cover is in place over the basin extension 24 of the present invention, the basin 2, discharge pipes 12, vent pipe 8 and power junction box 22 are concealed. The basin extension cover is flush with the floor 14. With the basin extension cover in place, the installation of the basin 2 and its related piping and power source is completely contained under the floor 14. As a result and in contrast to the prior art, the installation of the basin 2 and its related piping and power source do not use valuable space within the mechanical room.

The basin extension cover may be made of any suitable weight-bearing material, such as wood, metal, or the like, that can accommodate a heavy load placed upon it without collapsing, for example, that of a person standing on the basin extension cover. Accordingly, the basin extension cover can be used in the same fashion as which the rest of the floor 14 may be used, such as a person walking or standing thereon, or objects placed thereon. The basin extension 24 of the present invention allows the entire space and floor 14 area of the mechanical room to be used, such as for storage. The basin extension 24 of the present invention also allows for an aesthetically pleasing installation of a sewage ejector basin 2 system.

The basin extension 24 of the present invention may optionally have a basin extension pan 30 that is in perpendicular relation to a bottom edge of the basin extension sidewalls 26. The basin extension pan 30 has an opening therein which accommodates and abuts the basin 2. The benefit of the basin extension pan 30 is that no ground is exposed post-installation of the sewage ejector basin 2 system.

The basin extension 24 of the present invention may optionally have a drain opening 32 to accommodate a drain into the basin 2. A basin extension pan 30 may optionally have a pre-formed opening therein to accommodate the drain opening 32. Alternatively, an opening to accommodate the drain opening 32 may be made in a basin extension pan 30 onsite during installation. As previously mentioned, a benefit of the basin extension 24 of the present invention is that service performed on a sewage ejector basin system is more sanitary, because all of the contaminated fluids can be contained within the basin extension 24 during servicing and washed clean within the basin extension 24. The fluids can be washed through the drain opening 32 and back into the basin 2 by means of the drain.

The basin extension 24 of the present invention may be made of any suitable material that permits the basin extension sidewall 26 to be cut and to have openings created therein to allow the discharge pipe 12, vent pipe 8 and pump power cord 10 or pump power cord conduit 20 to pass through the basin extension sidewall 26; as well as the basin extension pan 30 to be cut and to have a drain 32 opening created therein. Suitable materials are wood, structural foam, plastic, polyethylene and the like. The openings may be created in the basin extension sidewall 26 or basin extension pan 32 with a keyhole drill or other appropriate tool onsite, in the exact position needed to accommodate the piping and power cord as determined during installation.

The basin extension 24 of the present invention may be made in any width and length dimensions suitable for accommodating basins 2 of varying sizes and diameters. The basin extension 24 of the present invention also may be made in any height dimensions suitable for accommodating basins 2 installed at varying depths below the ground. As mentioned above, the basin extension 24 of the present invention may be made of any suitable material that permits the basin extension sidewall 26 to be cut and, accordingly, the height of the basin extension 24 may be reduced as needed and determined during installation to accommodate an appropriate depth of the basin 2 below the floor 14.

Although the present invention has been described with reference to specific embodiments, it is understood that modifications and variations of the present invention are possible without departing from the scope of the invention, which is defined by the claims set forth below.

The invention claimed is:

1. A sewage ejector basin extension comprising:

a. four basin extension sidewalls in communicable relation to each other at right angles;

b. an opening within a top of the basin extension to allow access to the sewage ejector basin;

c. an opening within a bottom of the basin extension to accommodate a sewage ejector basin;

d. an opening within a sidewall of the basin extension to accommodate a discharge pipe;

e. an opening within a sidewall of the basin extension to accommodate a vent pipe; and f. an opening within a sidewall of the basin extension to accommodate a pump power cord;

wherein the basin extension is rectangular in shape; and further wherein the basin extension is contained within a floor and the top of the basin extension is flush with the floor.

2. The sewage ejector basin extension of claim 1; further wherein an annular flange is in relation to a top edge of the basin extension sidewalls and runs along and around a top perimeter of the basin extension.

3. The sewage ejector basin extension of claim 2; further wherein the basin extension annular flange may removably receive a basin extension cover.

4. The sewage ejector basin extension of claim 3; further wherein a basin extension cover is removably received within the basin extension annular flange; and further wherein the basin extension cover is flush with the floor.

5. The sewage ejector basin extension of claim 1; further wherein a basin extension pan is in perpendicular relation to the basin extension sidewalls.

6. The sewage ejector basin extension of claim 5; further wherein the basin extension pan has an opening therein which accommodates and abuts the basin.

7. The sewage ejector basin extension of claim 6; further wherein the basin extension pan has a drain opening therein.

8. A sewage ejector basin extension comprising:

a. four basin extension sidewalls in communicable relation to each other at right angles;

b. an opening within a top of the basin extension to allow access to the sewage ejector basin;

c. an opening within a bottom of the basin extension to accommodate a sewage ejector basin;

d. an annular flange in relation to a top edge of the basin extension sidewalls which runs along and around a top perimeter of the basin extension;

e. a basin extension pan in perpendicular relation to the basin extension sidewalls; wherein the basin extension pan has an opening therein which accommodates and abuts the basin;

f. an opening within a sidewall of the basin extension to accommodate a discharge pipe;

g. an opening within a sidewall of the basin extension to accommodate a vent pipe; and h. an opening within a sidewall of the basin extension to accommodate a pump power cord;

wherein the basin extension is rectangular in shape; and further wherein the basin extension is contained within a floor and the top of the basin extension is flush with the floor.

9. The sewage ejector basin extension of claim 8; further wherein the basin extension annular flange may removably receive a basin extension cover.

10. The sewage ejector basin extension of claim 9; further wherein a basin extension cover is removably received within the basin extension annular flange; and further wherein the basin extension cover is flush with the floor.

11. The sewage ejector basin extension of claim 8; further wherein the basin extension pan has a drain opening therein.

12. A sewage ejector basin extension comprising:

a. four basin extension sidewalls in communicable relation to each other at right angles;

b. an opening within a top of the basin extension to allow access to the sewage ejector basin;

c. an opening within a bottom of the basin extension to accommodate a sewage ejector basin;

d. an annular flange in relation to a top edge of the basin extension sidewalls which runs along and around a top perimeter of the basin extension; wherein the basin extension annular flange may removably receive a basin extension cover;

e. a basin extension cover removably received within the basin extension annular flange; wherein the basin extension cover is flush with a floor;

f. a basin extension pan in perpendicular relation to the basin extension sidewalls; wherein the basin extension pan has an opening therein which accommodates and abuts the basin; further wherein the basin extension pan has a drain opening therein;

g. an opening within a sidewall of the basin extension to accommodate a discharge pipe;

h. an opening within a sidewall of the basin extension to accommodate a vent pipe; and i. an opening within a sidewall of the basin extension to accommodate a pump power cord;

wherein the basin extension is rectangular in shape; and further wherein the basin extension is contained within the floor and the top of the basin extension is flush with the floor.

* * * * *